United States Patent [19]

Skorianetz et al.

[11] 4,118,343

[45] Oct. 3, 1978

[54] TRICYCLO[6.2.1.0$^{2,7}$]UNDEC-9-EN-3-ONE PERFUME COMPOSITION

[75] Inventors: Werner Skorianetz, Dardagny, Geneva; Günther Ohloff, Bernex, Geneva, both of Switzerland

[73] Assignee: Firmenich, S.A., Geneva, Switzerland

[21] Appl. No.: 824,905

[22] Filed: Aug. 15, 1977

[30] Foreign Application Priority Data

Aug. 20, 1976 [CH] Switzerland ..... 10606/76

[51] Int. Cl.$^2$ ..... C11B 9/00

[52] U.S. Cl. ..... 252/522; 260/586 R; 426/538; 131/17 R

[58] Field of Search ..... 252/522, 586 R

[56] References Cited

U.S. PATENT DOCUMENTS

| | | | |
|---|---|---|---|
| 3,953,534 | 4/1976 | Sundt | 252/522 |
| 3,968,070 | 7/1976 | Sundt | 252/522 |
| 3,979,338 | 9/1976 | Sundt | 252/522 |
| 3,981,892 | 9/1976 | Skorianetz | 252/522 |
| 3,984,355 | 10/1976 | Nagakura et al. | 252/522 |
| 4,014,938 | 3/1977 | Leidig | 252/522 |

OTHER PUBLICATIONS

Thomas S. Cantrell, J. Org. Chem., vol. 39, No. 21, pp. 3063–3070, 1974.

*Primary Examiner*—Veronica O'Keefe
*Attorney, Agent, or Firm*—Scully, Scott, Murphy & Presser

[57] ABSTRACT

Method for improving, enhancing or modifying the organoleptic properties of perfumes or perfume products as well as of foodstuffs in general, beverages and tobacco, by incorporating therein an oxygenated tricyclic derivative of norbornene.

3 Claims, No Drawings

TRICYCLO[6.2.1.0$^{2,7}$]UNDEC-9-EN-3-ONE PERFUME COMPOSITION

SUMMARY OF THE INVENTION

The invention relates to a method for improving, enhancing or modifying the odoriferous properties of perfumes or perfumed products as well as the flavour properties of foodstuffs, feedstuffs, beverages, pharmaceutical preparations and tobacco products, which method comprises adding thereto an effective amount of the compound of formula

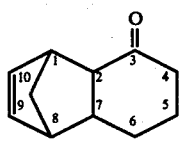

hereinafter referred to as tricyclo[6.2.1.0$^{2,7}$]undec-9-en-3-one.

The invention relates further to a perfume base, a perfume composition or a perfumed article containing as an active ingredient tricyclo[6.2.1.0$^{2,7}$]undec-9-en-3-one in combination with a support, a perfume coingredient, a diluent or an excipient.

The present invention relates also to a flavouring composition containing as an active ingredient tricyclo [6.2.1.0$^{2,7}$]undec-9-en-3-one.

Finally, the invention provides a perfumed or a flavoured article containing as perfuming or, respectively, flavouring ingredient tricyclo[6.2.1.0$^{2,7}$]undec-9-en-3-one.

BACKGROUND OF THE INVENTION

Tricyclo[6.2.1.0$^{2,7}$]undec-9-en-3-one is a known chemical compound first described in the scientific literature in J. Org. Chem., 39, 3063 (1974). It was prepared as a result of an investigation on the photochemical cycloaddition of cyclohexanone on cyclopentadiene. The cited reference does not describe any utility of the compound in question nor does it suggest any possible use of it as a perfume and/or flavour ingredient.

THE INVENTION

We have now surprisingly discovered that tricyclo [6.2.1.0$^{2,7}$]undec-9-en-3-one possesses useful organoleptic properties and consequently it can be advantageously used in a variety of perfume compositions, namely to confer or improve aromatic odoriferous notes. Its odour is reminiscent of that developed by plants such as wormwood (*Artemisia Absinthium*) or liatris; it is very powerful and it enables to confer an overall effect of naturalness to the composition to which it is added.

The proportions in which tricyclo[6.2.1.0$^{2,7}$]undec-9-en-3-one can produce the desired perfuming effects can vary within a broad range. Typically, these proportions are of about 1 to 20%, more particularly of about 5 to 10% by weight based on the total weight of the composition into which the active compound is incorporated. It is appreciated by those skilled in the art that these values are not absolute and proportions higher or lower than the above indicated limits can also be successfully employed, namely when tricyclo[6.2.1.0$^{2,7}$]undec-9-en-3-one is used to confer or modify the fragrance of articles such as soaps shampoos, beauty creams, talc powders, deodorizers, air fresheners, detergents or household materials in general.

In the field of aromatization, tricyclo[6.2.1.0$^{2,7}$]undec-9-en-3-one develops gustative characters of various types such as e.g. woody, fatty or animal, notes which are reminiscent of certain aspects of the taste of fish or algae extracts. The compound of the invention possesses moreover a herbal and minty character.

Preferred concentrations are of between about 0.5 and 50 ppm (parts per million) by weight based on the total weight of the aromatized product.

As used throughout this specification, the term "foodstuff" includes also consumable articles such as tea, coffee or chocolate.

Tricyclo[6.2.1.0$^{2,7}$]undec-9-en-3-one can be used in accordance to the invention on its own, in solution in inert solvents such as triacetine, ethylalcohol or diethylenglycol or in admixture with other coingredients.

Tricyclo[6.2.1.0$^{2,7}$]undec-9-en-3-one can be obtained according to the known process described in the cited literature [see: J. Org. Chem. op. cit.].

Alternatively, it can be prepared as follows:

A mixture of 19.2 g (0.2 M) of cyclohex -2-en-1-one and 33 g (0.5 M) of freshly prepared cyclopenta-1,3-diene was added dropwise under stirring to a solution kept at 0°–5° of 1 g of anhydrous tin tetrachloride in 20 ml of methylene chloride. Once the addition was over, the temperature of the mixture was slowly increased to 20°–25° and kept under stirring for subsequent 9 hours, whereupon 100 ml of 5% aqueous HCl were added thereto and extracted with methylene cloride. The combined organic extracts were washed with 5% aqueous HCl, then with water followed by 5% aqueous sodium chloride until neutrality.

After drying over sodium sulphate a bulb distillation gave 22 g of a raw product having b.p. 100°–180°/0.5 Torr. A subsequent fractional distillation yielded 17 g (yield = 52%) of tricyclo[6.2.1.0$^{2,7}$]undec-9-en-3-one as a colorless liquid having b.p. 50°–53°/0.4 Torr; $n_D^{20}$ = 1.5210; $d_4^{20}$ = 1.084. IR (neat): 3050, 1710 and 730 cm$^{-1}$.

The temperatures indicated hereinabove are given in degrees centigrade and the abbreviations have the meaning common in the art.

The invention is better illustrated by but not limited to the following examples.

EXAMPLE 1

Perfume Composition

A base perfume composition destined to be incorporated into a medical shampoo was prepared by mixing together the following ingredients (parts by weight):

| | |
|---|---|
| Trimethylhexyl acetate | 200 |
| Lavandin oil | 100 |
| Linalol | 100 |
| p-ter-Butylcyclohexyl acetate | 80 |
| Synthetic bergamot oil | 80 |
| Benzyl benzoate | 70 |
| Discolorized oak-moss absolute (50%*) | 60 |
| Methoxyphenethylol | 40 |
| Citrate mint oil | 40 |
| trans-Epoxy-ocimene** 10%* | 40 |
| Cyclopentadecanolide 10%* | 30 |
| Isobornyl acetate | 20 |
| Methyl-nonyl acetaldehyde 10%* | 20 |
| Methyl salicylate 1%* | 10 |
| Discolorized mate absolute 10%* | 10 |
| Aspic oil | 40 |
| Caryolan*** | 10 |

-continued

| | |
|---|---|
| Total | 950 |

*in diethyl phthalate
**origin: Firmenich SA, Geneva, Switzerland
***mixture of 4,4,8-trimethyl-tricyclo[6.3.1.0$^{2,5}$]dodec- 1-yl-formate and 4,4,8-trimethyl-tricyclo[6.3.1.0$^{1,5}$]dodec-2-yl formate, see e.g. U.K. Pat. No. 1,418,600.

The above indicated perfume base possessed a rather pleasant lavender scent. By adding 5 g of tricyclo [6.2.1.0$^{2,7}$]undec-9-en-3-one to 95 g of the said perfume base there was obtained a novel composition the odorous character of which distinctly turned to a well distinct "medical" note.

EXAMPLE 2

Foodstuff Aromatization

A clear soup of bland taste was prepared by dissolving 10 g of commercial soup gravy in 500 ml of boiling water. The thus prepared foodstuff was divided into several portions of 30 ml each. Half of the portions were flavoured by adding tricyclo[6.2.1.0$^{2,7}$]undec-9-en-3-one at a weight concentration of 2 ppm (parts per million) based on the total weight of the flavoured foodstuff.

The obtained samples were subjected to an evaluation by a panel of experienced flavourists who express their view on the taste of the flavoured foodstuff by comparison with unflavoured soup by defining it as having a very marked "fish" character.

EXAMPLE 3

Tobacco Aromatization 0.5 g of a 1% solution of tricyclo[6.2.1.0$^{2,7}$]undec-9-en-3-one in 95% ethanol were sprayed onto 100 g of a tobacco mixture of the "american blend" type. The tobacco thus flavoured was then used for the manufacture of "test" cigarettes the smoke of which was subjected to an organoleptic evaluation by a panel of flavour experts. These latter declared that the smoke of the test cigarettes presented a more herbal, slightly fruity and floral flavour note.

We claim:

1. A perfume composition containing as an active ingredient tricyclo [6.2.1.0$^{2,7}$]undec-9-en-3-one in combination with a diluent.

2. A method of modifying the odor of a perfume composition which comprises adding thereto an effective amount of tricyclo [6.2.1.0$^{2,7}$]undec-9-en-3-one.

3. The perfume composition produced by the method of claim 2.

* * * * *